US008398866B2

(12) United States Patent
Ozawa et al.

(10) Patent No.: US 8,398,866 B2
(45) Date of Patent: Mar. 19, 2013

(54) MICROCHIP FOR FORMING EMULSION AND METHOD FOR MANUFACTURING THE SAME

(75) Inventors: Yutaka Ozawa, Kashiwa (JP); Ryoichi Ohigashi, Kashiwa (JP); Koji Fujimoto, Taito-Ku (JP); Shoji Takeuchi, Shibuya-Ku (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 13/525,639

(22) Filed: Jun. 18, 2012

(65) Prior Publication Data

US 2012/0248062 A1 Oct. 4, 2012

Related U.S. Application Data

(62) Division of application No. 12/507,369, filed on Jul. 22, 2009, now Pat. No. 8,231,265.

(30) Foreign Application Priority Data

Jul. 29, 2008 (JP) ..... 2008-194919

(51) Int. Cl.
*B01F 5/08* (2006.01)

(52) U.S. Cl. ..... 216/2; 366/162.4; 366/181.6

(58) Field of Classification Search ... 216/2; 366/162.4, 366/181.6, 181.5, 336, 337, DIG. 1–DIG. 4
See application file for complete search history.

(56) References Cited

U.S. PATENT DOCUMENTS

| | | | |
|---|---|---|---|
| 5,296,375 | A | 3/1994 | Kricka et al. |
| 5,482,598 | A | 1/1996 | Isaka et al. |
| 2004/0100861 | A1 | 5/2004 | Vanden Bussche et al. |
| 2005/0092681 | A1 | 5/2005 | Higashino et al. |
| 2005/0207274 | A1 | 9/2005 | Johnson et al. |
| 2010/0204459 | A1 * | 8/2010 | Mason et al. ..... 530/408 |

FOREIGN PATENT DOCUMENTS

| | | | |
|---|---|---|---|
| JP | 10-318982 | A1 | 12/1998 |
| JP | 3402635 | B2 | 2/2003 |
| JP | 2005-144356 | A1 | 6/2005 |
| JP | 2005-152740 | A1 | 6/2005 |
| JP | 2006-167719 | A1 | 6/2006 |
| JP | 2008-116254 | A1 | 5/2008 |

OTHER PUBLICATIONS

Japanese Office Action dated Mar. 13, 2012 (with English translation).
Japanese Office Action dated Aug. 3, 2012 (with English translation).

* cited by examiner

*Primary Examiner* — David Sorkin
(74) *Attorney, Agent, or Firm* — Burr & Brown

(57) ABSTRACT

A microchip for forming an emulsion has a first glass substrate, a second glass substrate and a silicon substrate. The silicon substrate has formed therein a first fluid flow path through which a first fluid flows and a second fluid flow path through which a second fluid that is not mixed with the first fluid flows. The first fluid flow path has a plurality of branched flow paths that join at a joint portion. The second fluid flow path communicates with the joint portion. The silicon substrate has formed therein an emulsion formation flow path that faces an edge portion of the second fluid flow path at the joint portion. An emulsion composed of the first fluid and the second fluid that is surrounded by the first fluid is formed in the emulsion formation flow path.

4 Claims, 10 Drawing Sheets

MICROCHIP FOR FORMING EMULSION AND METHOD FOR MANUFACTURING THE SAME

CROSS REFERENCE TO RELATED APPLICATIONS

This application is a division of U.S. application Ser. No. 12/507,369, having a filing date of Jul. 22, 2009, and claims the benefit under 35 USC §119(a)-(d) of Japanese Application No. 2008-194919, filed Jul. 29, 2008, the entireties of which are incorporated herein by reference.

FIELD OF THE INVENTION

The present invention relates to a microchip that is adapted to form an emulsion and has first and second glass substrates and a silicon substrate provided between the first and second glass substrates, and to a method for manufacturing the microchip for forming an emulsion.

BACKGROUND OF THE INVENTION

In recent years, research has been carried out on cell analysis, chemical reaction, biochemical reaction, biochemical separation, biochemical analysis, etc. using a microchip called a micro total analysis system (μ-TAS), a microchip called a lab-on-a-chip, or a microchip called a micro electro mechanical system (MEMS). Such a microchip includes a plate having sides of several centimeters. The plate has formed therein a flow path of micrometer order and several types of sample introduction holes. The flow path is branched into multiple flow paths, while the branched flow paths join.

The microchip is a system adapted to react, separate and analyze a solution by causing the solution to flow in the flow path (refer to Japanese Patent No. 3402635 B2). It is known that the system is capable of reacting, separating and analyzing a small amount of a sample and improving the efficiency of the reaction. The microchip has attracted attention.

On the other hand, research has been carried out on a technique for generating a fine emulsion (droplet) in a micro flow path in the fields of chemicals, cosmetics, electronic members or electronic materials (LCD spacer and the like) or drug delivery. The emulsion is formed by using two types of fluids (such as water and oil) that are not mixed with each other due to low affinity with each other and dispersing one of the two types of fluids into the other. Typical emulsions are the following two types: a water-in-oil type emulsion formed by dispersing a water droplet into an oil phase; and an oil-in-water type emulsion formed by dispersing an oil droplet into a water phase.

The emulsion is formed using a flow path having a T-junction, for example. Referring to FIG. 14, a T-shaped flow path 101 provided with a T-junction includes flow paths 102 and 103. The flow path 102 is provided for a continuous phase. The flow path 103 is provided for a dispersed phase and perpendicular to the flow path 102. In the T-shaped flow path 101 shown in FIG. 14, water 104 is supplied to the flow path 102, and oil 105 is supplied from the flow path 103 to the flow path 102. In the flow path 101, therefore, a water-in-oil emulsion 106 composed of the oil 105 and the water 104 (that surrounds the oil 105) can be formed.

When the T-shaped flow path 101 shown in FIG. 14 is used, however, the size of the emulsion 106 varies based on the width $w_0$ of the flow path 102. For example, when the width $w_0$ of the flow path 102 is 100 μm, the size of the emulsion 106 is approximately 50 μm. A reduction in the width $w_0$ of the flow path 102 is limited. It is, therefore, difficult to form a fine emulsion 106 of 1 μm or less using the microchip having the T-shaped flow path 101.

In a conventional technique, a substrate in which a flow path is provided to form an emulsion is generally made of a synthetic resin material such as polydimethylsiloxane (PDMS) (refer to JP 2008-116254 A1). However, when a fluid flows in a flow path provided in a PDMS substrate at high pressure in order to form an emulsion, the fluid pressure may cause transformation of the flow path and an increase in the width of the flow path. It is, therefore, difficult to form such a fine emulsion as described above using a microchip having the PDMS substrate.

In addition, there is a technique for forming a fine emulsion using an ultrasonic wave. However, there is a problem that the size of an emulsion particle is not constant.

It is, therefore, an object of the present invention to provide a microchip capable of forming a fine emulsion in a stable manner, and a method for manufacturing the microchip for forming an emulsion.

SUMMARY OF THE INVENTION

According to the present invention, a microchip for forming an emulsion comprises: a first glass substrate; a second glass substrate; and a silicon substrate provided between the first and second glass substrates, wherein the silicon substrate has formed therein a first fluid flow path through which a first fluid flows and a second fluid flow path through which a second fluid that is not mixed with the first fluid flows; the first fluid flow path has a plurality of branched flow paths that join at a joint portion; the second fluid flow path has an edge portion that communicates with the joint portion; and the silicon substrate has formed therein an emulsion formation flow path to form an emulsion composed of the first fluid and the second fluid that is surrounded by the first fluid, the emulsion formation flow path facing the edge portion of the second fluid flow path.

In the microchip for forming an emulsion according to the present invention, the silicon substrate has a restricting portion formed between the joint portion and the emulsion formation flow path.

In the microchip for forming an emulsion according to the present invention, the restricting portion extends through the silicon substrate in the direction of the thickness of the silicon substrate.

In the microchip for forming an emulsion according to the present invention, the restricting portion has a height smaller than the thickness of the silicon substrate and has an opening facing toward the second glass substrate.

In the microchip for forming an emulsion according to the present invention, the surfaces of the restricting portion is entirely surrounded by the silicon substrate.

In the microchip for forming an emulsion according to the present invention, the first glass substrate or the second glass substrate has formed therein a first fluid inflow hole, the first fluid inflow hole communicating with the first fluid flow path of the silicon substrate and is adapted to introduce the first fluid to the first fluid flow path, the first glass substrate or the second glass substrate has formed therein a second fluid inflow hole, the second fluid inflow hole communicating with the second fluid flow path of the silicon substrate and is adapted to introduce the second fluid to the second fluid flow path, and the first glass substrate or the second glass substrate has formed therein an emulsion outflow hole, the emulsion outflow hole communicating with the emulsion formation flow path of the silicon substrate and allows the emulsion to flow out of the emulsion formation flow path.

According to the present invention, a method for manufacturing a microchip adapted to form an emulsion and having a first glass substrate, a second glass substrate and a silicon substrate provided between the first and second glass substrates, comprises: preparing the first glass substrate and the silicon substrate; bonding the first glass substrate with the silicon substrate; polishing the silicon substrate provided on the first glass substrate to ensure that the silicon substrate has a predetermined thickness; forming flow paths in the silicon substrate having the predetermined thickness by etching; and bonding the second glass substrate with the silicon substrate having the flow paths formed therein, wherein in forming the flow paths in the silicon substrate, a first fluid flow path through which a first fluid flows is formed in the silicon substrate, a second fluid flow path through which a second fluid that is not mixed with the first fluid flows is formed in the silicon substrate, and an emulsion formation flow path is formed in the silicon substrate to form an emulsion composed of the first fluid and the second fluid that is surrounded by the first fluid; the first fluid flow path has a plurality of branched flow paths that join at a joint portion; and the second fluid flow path has an edge portion that communicates with the joint portion.

In the method according to the present invention, in forming the flow paths in the silicon substrate, a restricting portion extending through the silicon substrate in the direction of the thickness of the silicon substrate is formed between the joint portion and the emulsion formation flow path.

In the method according to the present invention, in forming the flow paths in the silicon substrate, a restricting portion is formed between the joint portion and the emulsion formation flow path, the restricting portion having a height smaller than the thickness of the silicon substrate and having an opening facing toward the second glass substrate.

In the method according to the present invention, in forming the flow paths in the silicon substrate, a restricting portion is formed between the joint portion and the emulsion formation flow path, the surfaces of the restricting portion being entirely surrounded by the silicon substrate.

According to the present invention, the silicon substrate has formed therein the first fluid flow path (in which the first fluid flows), the second fluid flow path (in which the second fluid that is not mixed with the first fluid flows) and the emulsion formation flow path (in which an emulsion is formed). This configuration allows a fine emulsion composed of the first fluid and the second fluid (that is surrounded by the first fluid) to be formed in a stable manner.

DETAILED DESCRIPTION OF THE INVENTION

First Embodiment

The first embodiment of the present invention is described below with reference to the accompanying drawings.

Figure 1:
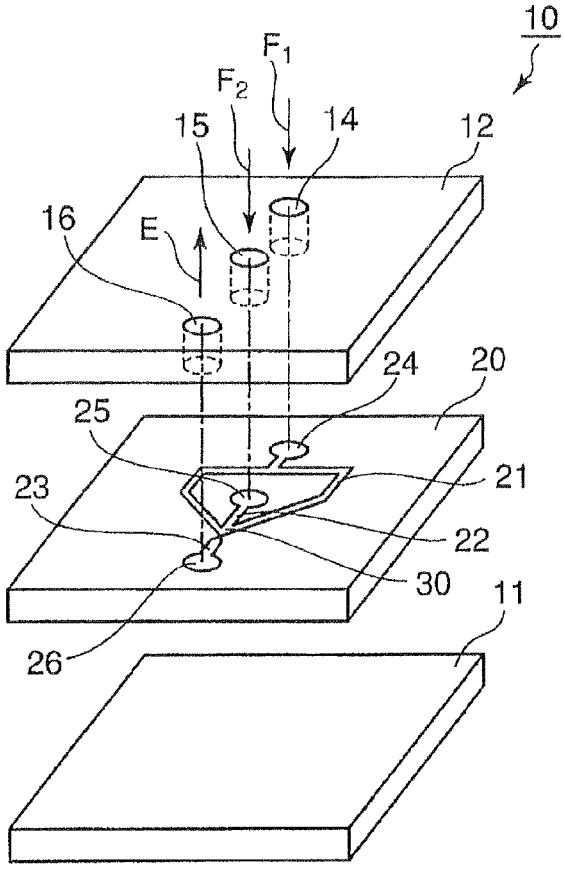
FIG. 1 is an exploded perspective view of a microchip for forming an emulsion according to a first embodiment of the present invention.
Figure 2:
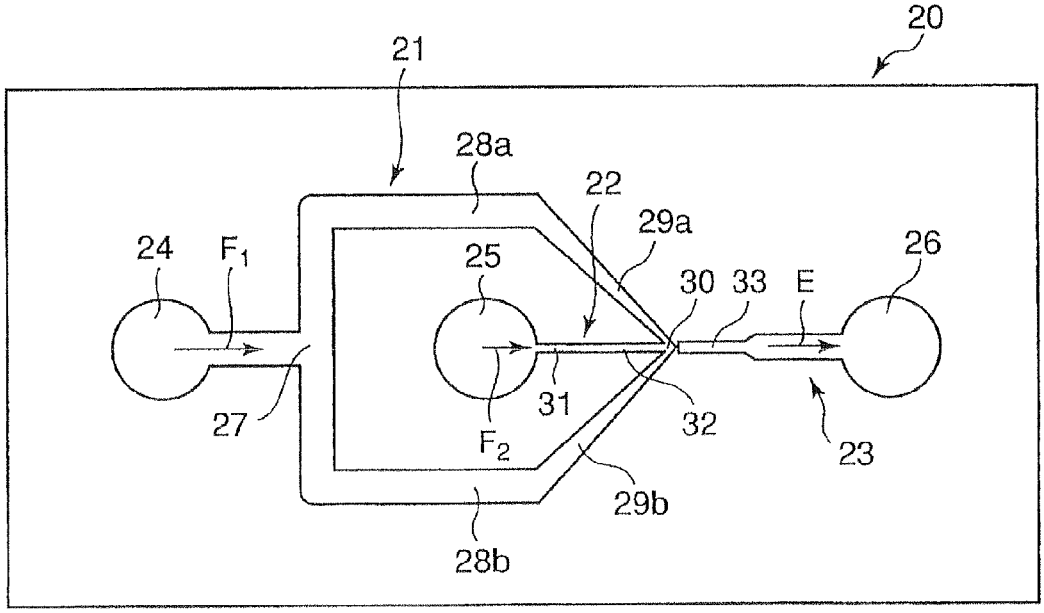
FIG. 2 is a plan view of a silicon substrate included in the microchip for forming an emulsion according to the first embodiment.
Figure 3:
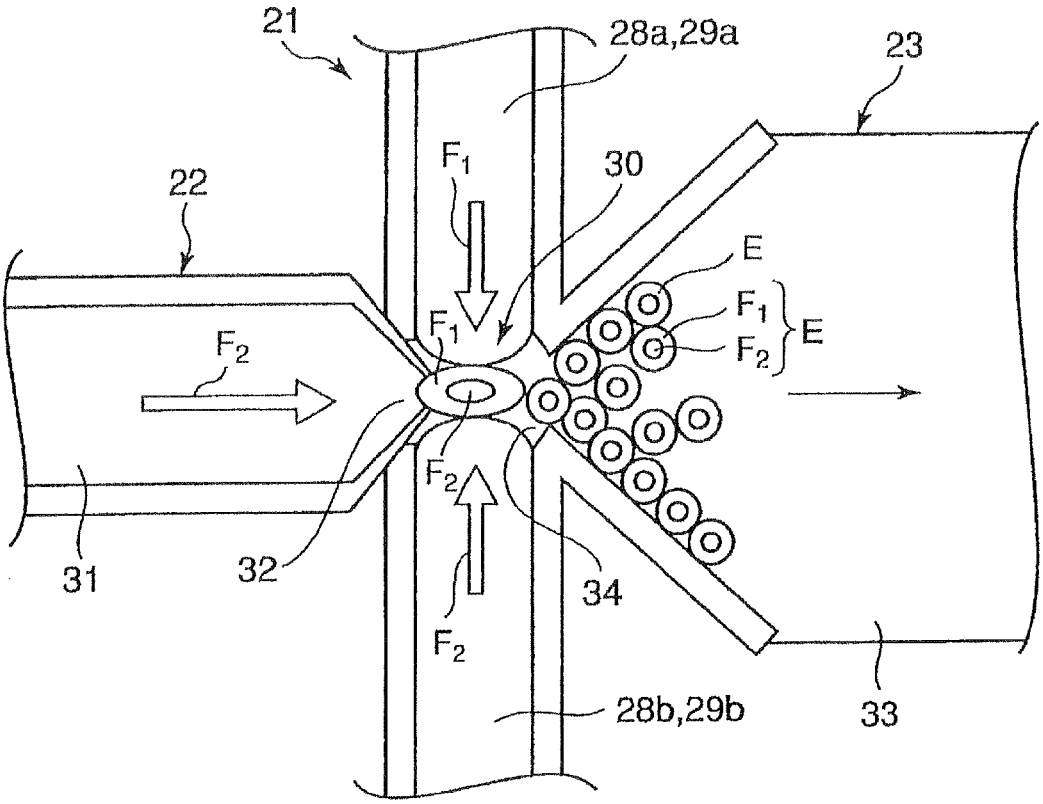
FIG. 3 is an outline enlarged view of the periphery of a junction portion of the silicon substrate included in the microchip for forming an emulsion according to the first embodiment.
Figure 4:
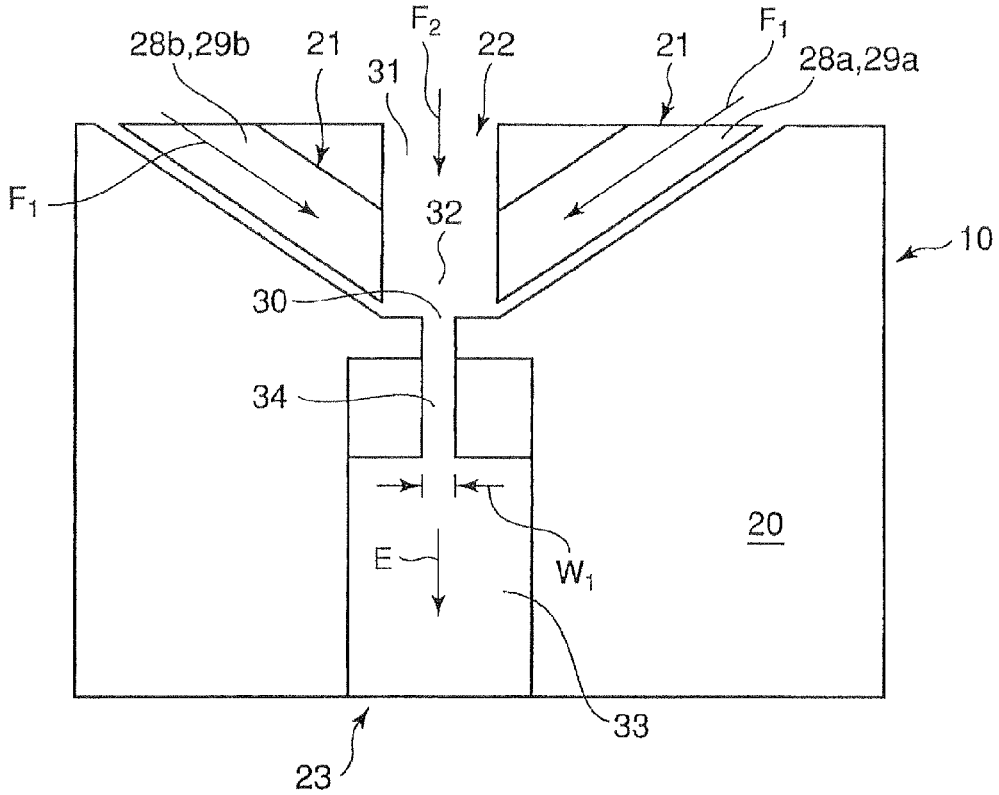
FIG. 4 is a perspective view of the periphery of a restricting portion of the silicon substrate included in the microchip for forming an emulsion according to the first embodiment when viewed from an emulsion formation flow path.
Figure 5:
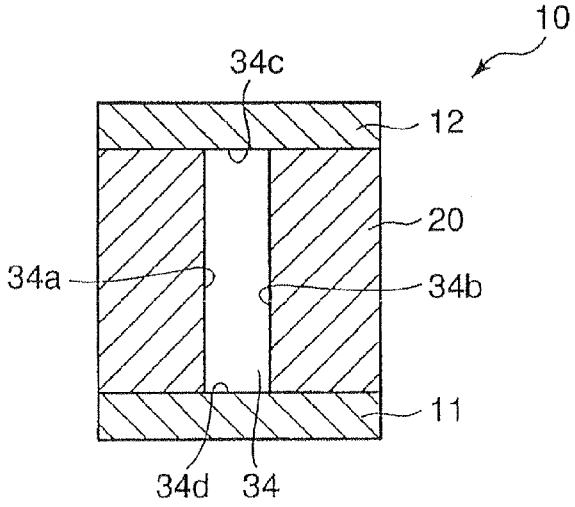
FIG. 5 is a vertical cross-sectional view of the restricting portion of the silicon substrate included in the microchip for forming an emulsion according to the first embodiment.
Figure 6:
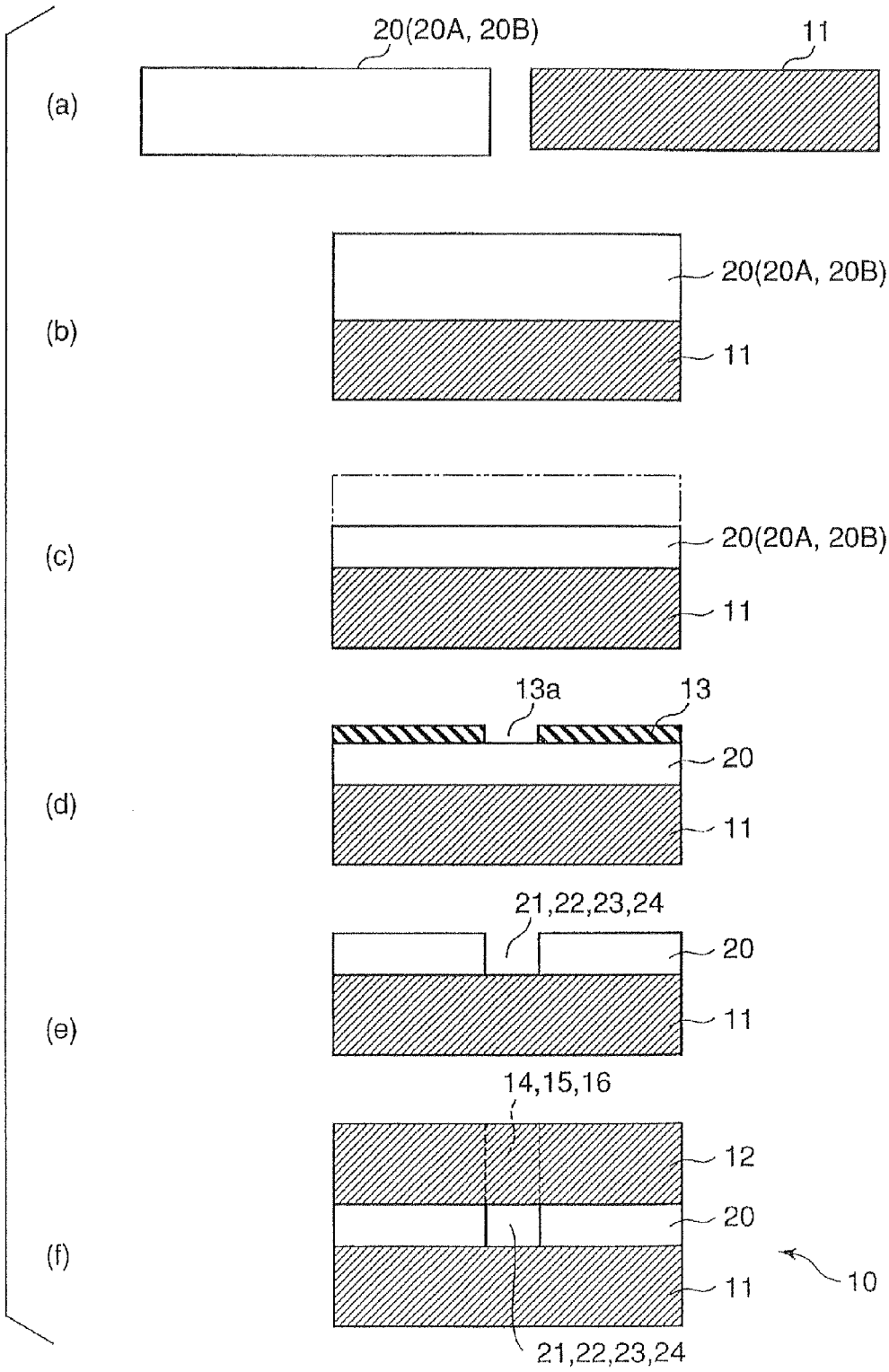
FIGS. 6(*a*) to 6(*f*) are diagrams showing a method for manufacturing the microchip for forming an emulsion according to the present embodiment.

FIG. 1 is an exploded perspective view of a microchip for forming an emulsion according to the first embodiment. FIG. 2 is a plan view of a silicon substrate included in the microchip for forming an emulsion according to the first embodiment. FIG. 3 is an outline enlarged view of the periphery of a junction portion of the silicon substrate included in the microchip for forming an emulsion according to the first embodiment. FIG. 4 is a perspective view of the periphery of a restricting portion of the silicon substrate included in the microchip for forming an emulsion according to the first embodiment when viewed from an emulsion formation flow path. FIG. 5 is a vertical cross-sectional view of the restricting portion of the silicon substrate included in the microchip for forming an emulsion according to the first embodiment. FIGS. 6(*a*) to 6(*f*) are diagrams showing a method for manufacturing the microchip for forming an emulsion according to the first embodiment.

Configuration of Microchip for Forming Emulsion

First, the outline of the microchip for forming an emulsion according to the present embodiment is described with reference to FIGS. 1 to 5.

In FIG. 1, reference numeral 10 denotes the microchip (flow path device) for forming an emulsion, and reference numeral 20 denotes the silicon substrate. The microchip 10 has a first glass substrate 11, a second glass substrate 12 and the silicon substrate 20. The silicon substrate 20 is provided between and bonded with the first glass substrate 11 and the second glass substrate 12.

The second glass substrate 12 has a first fluid inflow hole 14, a second fluid inflow hole 15 and an emulsion outflow hole 16. The first fluid inflow hole 14, the second fluid inflow hole 15 and the emulsion outflow hole 16 extend through the second glass substrate 12 in the direction of the thickness of the second glass substrate 12.

The first fluid inflow hole 14 is adapted to introduce a first fluid $F_1$ from the outside of the microchip 10 (for forming an emulsion) to the silicon substrate 20. As described later, the first fluid inflow hole 14 communicates with an inflow portion (first fluid inflow portion 24) of a first fluid flow path 21 provided in the silicon substrate 20. The second fluid inflow hole 15 is adapted to introduce a second fluid $F_2$ from the outside of the microchip 10 (for forming an emulsion) to the silicon substrate 20. As described later, the second fluid inflow hole 15 communicates with an inflow portion (second fluid inflow portion 25) of a second fluid flow path 22 provided in the silicon substrate 20.

The emulsion outflow hole 16 communicates with an outflow portion (emulsion outflow portion 26) of an emulsion formation flow path 23 provided in the silicon substrate 20 as described later. The emulsion outflow hole 16 is adapted to cause an emulsion E formed in the emulsion formation flow path 23 to flow out of the emulsion formation flow path 23 to the outside of the microchip 10 for forming an emulsion.

The second glass substrate 12 is made of Pyrex (registered trademark of Corning Incorporated) glass or the like.

The first glass substrate 11 is entirely flat and has a plate shape. The first glass substrate 11 is configured in substantially the same manner as the second glass substrate 12 except that the first glass substrate 11 does not have the first fluid inflow hole 14, the second fluid inflow hole 15 and the emulsion outflow hole 16. The first glass substrate 11 is made of Pyrex (registered trademark of Corning Incorporated) glass or the like in the same manner as the second glass substrate 12.

The silicon substrate 20 is made of silicon. The silicon substrate 20 has the first fluid flow path 21, the second fluid flow path 22 and the emulsion formation flow path 23. The first fluid $F_1$ flows in the first fluid flow path 21. The second fluid $F_2$ flows in the second fluid flow path 22. The second fluid $F_2$ flowing in the second fluid flow path 22 is not mixed with the first fluid $F_1$. The emulsion E is formed in the emulsion formation flow path 23. The first fluid flow path 21, the second fluid flow path 22 and the emulsion formation flow path 23 extend through the silicon substrate 20 in the direction of the thickness of the silicon substrate 20.

As shown in FIG. 2, the first fluid flow path 21 has the first fluid inflow portion 24 on an upstream side thereof. The first fluid inflow portion 24 communicates with the first fluid inflow hole 14 of the second glass substrate 12. The first fluid flow path 21 has a branch portion 27 on a downstream side of the first fluid inflow portion 24. In addition, the first fluid flow path 21 is branched at the branch portion 27 and has a pair of branched flow paths 28*a* and 28*b*. The branched flow paths 28*a* and 28*b* have respective taper portions 29*a* and 29*b* on downstream sides thereof. Each of the taper portions 29*a* and 29*b* extends at an acute angle with respect to a direction in which a straight flow path portion 31 (described later) of the second fluid flow path 22 extends. The branched flow paths 28*a* and 28*b* join at a joint portion 30 formed at edges of the taper portions 29*a* and 29*b*.

The second fluid flow path 22 has a second fluid inflow portion 25 that communicates with the second fluid inflow hole 15 of the second glass substrate 12. The straight flow path 31 extends straight from the second fluid inflow portion 25. The straight flow path 31 has an edge portion 32 on a downstream side thereof. The edge portion 32 communicates with the joint portion 30.

The emulsion formation flow path 23 is adapted to form the emulsion E. The emulsion E is composed of the first fluid $F_1$ (that flows from the first fluid flow path 21) and the second fluid $F_2$ (that flows from the second fluid flow path 22) that is surrounded by the first fluid $F_1$ (as shown in FIG. 3).

As shown in FIG. 2, the emulsion formation flow path 23 communicates with the joint portion 30 and faces the edge portion 32 of the second fluid flow path 22. In addition, the emulsion formation flow path 23 has an emulsion formation flow path body 33 and an emulsion outflow portion 26. The emulsion outflow portion 26 is connected with the emulsion formation flow path body 33. The emulsion outflow portion 26 communicates with the emulsion outflow hole 16 of the second glass substrate 12 as described above.

As shown in FIG. 4, the silicon substrate 20 has formed therein a restricting portion 34 provided between the joint portion 30 and the emulsion formation flow path body 33 of the emulsion formation flow path 23.

The restricting portion 34 has a width $w_1$ smaller than the width of the emulsion formation flow path body 33. The width $w_1$ of the restricting portion 34 is in a range of 1 μm to 30 μm, for example. As shown in FIG. 5, the restricting portion 34 extends through the silicon substrate 20 in the direction of the thickness of the silicon substrate 20. The restricting portion 34 has a pair of side surfaces 34*a* and 34*b*. In addition, the restricting portion 34 has a top part 34*c* and a bottom part 34*d*. The top part 34*c* is open toward the second glass substrate 12, while the bottom part 34*d* is open toward the first glass substrate 11.

Referring to FIG. 1, a film layer made of silicon dioxide ($SiO_2$), nitrogen dioxide ($Si_3N_4$) or the like and having a thickness of approximately 0.1 μm to 1 μm may be provided between the first glass substrate 11 and the silicon substrate 20 and/or between the second glass substrate 12 and the silicon substrate 20.

Effect of Microchip for Forming Emulsion

Next, an effect of the microchip for forming an emulsion according to the present embodiment is described below with reference to FIGS. 1 to 3.

As shown in FIG. 1, the first fluid $F_1$ is introduced from the first fluid inflow hole 14 of the second glass substrate 12 at a rate ranging from 40 μl/min to 200 μl/min, for example. Simultaneously, the second fluid $F_2$ is introduced from the second fluid inflow hole 15 of the second glass substrate 12 at a rate of 3 μl/min, for example.

Next, the first fluid $F_1$ introduced from the first fluid inflow hole 14 reaches the branch portion 27 through the first fluid inflow portion 24 as shown in FIG. 2. After that, the first fluid $F_1$ is divided at the branch portion 27. Then, the divided first fluids $F_1$ flow in the branched flow paths 28*a* and 28*b*. The divided first fluids $F_1$ pass through the taper portions 29*a* and 29*b* and reach the joint portion 30. On the other hand, the second fluid $F_2$ introduced from the second fluid inflow hole 15 passes through the second fluid inflow portion 25 and the straight flow path 31 and reaches the joint portion 30.

The first fluid $F_1$ and the second fluid $F_2$ join at the joint portion 30. After that, the first fluid $F_1$ and the second fluid $F_2$ are pushed toward the emulsion formation flow path 23. Thus, the first fluid $F_1$ and the second fluid $F_2$ pass through the narrow restricting portion 34. When the first fluid $F_1$ and the second fluid $F_2$ pass through the narrow restricting portion 34, a large number of fine emulsions E are formed (refer to FIG.

3). Each of the emulsions E is composed of the first fluid $F_1$ and the second fluid $F_2$ (that is located on the inner side of the emulsion E and surrounded by the first fluid $F_1$). Each of the emulsions E has a size of 0.1 μm to 10 μm.

After the formation of the emulsions E, the emulsions E pass through the emulsion formation flow path body 33 of the emulsion formation flow path 23 and the emulsion outflow portion 26. Then, the emulsions E flow out of the emulsion outflow hole 16 of the second glass substrate 12.

FIG. 3 shows that the first fluid $F_1$ and the second fluid $F_2$ join at the right angle for the sake of convenience. In fact, however, the first fluids $F_1$ flowing in the branched flow paths 28*a* and 28*b* and the second fluid $F_2$ join at an acute angle.

As a combination of the first fluid $F_1$ and the second fluid $F_2$, a combination of a fluid composed of hexadecane (oil) and a fluid composed of water containing a nonionic surface active agent Span 80 (sorbitan monooleate) may be used. That is, the first fluid $F_1$ may be composed of hexadecane (oil), while the second fluid $F_2$ may be composed of water containing a nonionic surface active agent Span 80 (sorbitan monooleate). Alternatively, the first fluid $F_1$ may be composed of water containing a nonionic surface active agent Span 80 (sorbitan monooleate), while the second fluid $F_2$ may be composed of hexadecane (oil). The combination of the first fluid $F_1$ and the second fluid $F_2$ is not limited to the aforementioned combination. The first fluid $F_1$ and the second fluid $F_2$ may be any fluids as long as the first fluid $F_1$ and the second fluid $F_2$ have low affinities with each other.

Method for Manufacturing Microchip for Forming Emulsion

Next, the method for manufacturing the microchip for forming an emulsion according to the present embodiment is described below with reference to FIGS. 6(*a*) to 6(*f*).

First, the first glass substrate 11 and the silicon substrate 20 are prepared (as shown in FIG. 6(*a*)). The first glass substrate 11 has a thickness of 300 μm to 800 μm. In addition, the first glass substrate 11 is flat and has a plate shape. Furthermore, the first glass substrate 11 is preferably composed of glass containing a mobile ion such as a sodium (Na) ion in the case where the first glass substrate 11 and the silicon substrate 20 are bonded with each other by anodic bonding. The glass containing a mobile ion may be Pyrex (registered trademark of Corning Incorporated) glass. The surface of the first glass substrate 11, which is to be in contact with the silicon substrate 20, may be hydrophilically or hydrophobically treated by being subjected to a plasma treatment.

The silicon substrate 20 has a thickness of 300 μm to 800 μm. In addition, the silicon substrate 20 is flat and has a plate shape. In the case where the silicon substrate 20 and the first glass substrate 11 are bonded with each other by anodic bonding, at least the surface (to be bonded with the first glass substrate 11 by anodic bonding) of the silicon substrate 20 is preferably subjected to mirror polishing.

Next, the silicon substrate 20 is bonded with the first glass substrate 11 by anodic bonding (as shown in FIG. 6(*b*)). The anodic bonding is to overlap glass with silicon and apply heat and a voltage to the glass and the silicon so as to bond the glass with the silicon. In this principle, the heat and the voltage are simultaneously applied to the glass and the silicon under the condition that the glass serves as a cathode and the silicon serves as an anode. The application of the heat and the voltage forcibly disperses a cation contained in the glass to the side of the cathode to generate electrostatic attractive force between the glass and the silicon. Thus, the generated electrostatic attractive force promotes adhesion of the glass and the silicon and causes the glass and the silicon to chemically react with each other. In this way, the glass and the silicon are bonded with each other. A voltage of 300 V to 500 V is applied between the first glass substrate 11 and the silicon substrate 20 to bond the first glass substrate 11 with the silicon substrate 20 by anodic bonding under the condition that the first glass substrate 11 and the silicon substrate 20 are heated at a temperature of 300° C. to 500° C.

The first glass substrate 11 and the silicon substrate 20 may be bonded with each other by means of adhesive resin. The adhesive resin may be benzocyclobutene resin. When benzocyclobutene resin is used as the adhesive resin, the first glass substrate 11 and the silicon substrate 20 are heated at a temperature of 250° C. and pressed at a pressure level of 3.5 kN under vacuum for 30 minutes to be bonded with each other. When photosensitive resin such as the benzocyclobutene resin is used as the adhesive resin, a region bonded by means of the adhesive resin can be patterned by a photolithographic method. The pattering allows the first glass substrate 11 and the silicon substrate 20 to be bonded with each other under the condition that the adhesive resin is not present in the first fluid flow path 21, the second fluid flow path 22 and the emulsion formation flow path 23. This suppresses an effect of the adhesive resin on the formation of the emulsions.

The first glass substrate 11 and the silicon substrate 20 may be bonded with each other by eutectic bonding (in which, for example, the substrates 11 and 20 has respective metal (Au, Au—Sn) films, and the metal films contact each other and are heated at a temperature of approximately 400° C. to be alloyed and bonded with each other).

Next, the silicon substrate 20 located on the first glass substrate 11 is polished to have a predetermined thickness (as shown in FIG. 6(*c*)). In this case, a grinder (polishing device) is used to polish the silicon substrate 20 to ensure that the silicon substrate 20 has a (predetermined) thickness of 10 μm to 200 μm, for example. The thus polished surface of the silicon substrate 20 is preferably subjected to mirror polishing in the case where the silicon substrate 20 and the second glass substrate 12 are bonded with each other by anodic bonding after the first polishing.

Then, the first fluid flow path 21, the second fluid flow path 22 and the emulsion formation flow path 23 are formed in the polished silicon substrate 20 having the predetermined thickness by etching (as shown in FIGS. 6(*d*) and 6(*e*)).

Before the formation of the flow paths 21 to 23, an etching mask 13 having an opening 13*a* is formed on the silicon substrate 20 (as shown in FIG. 6(*d*)). The opening 13*a* is provided at a location corresponding to the first fluid flow path 21, the second fluid flow path 22 and the emulsion formation flow path 23. The etching mask 13 is made of any of materials including a resist, a silicon dioxide film, a silicon nitride film, and other metal materials.

Next, etching is performed on a region (of the silicon substrate 20) corresponding to the opening 13*a* that is not covered with the etching mask 13 to form the first fluid flow path 21, the second fluid flow path 22 and the emulsion formation flow path 23 (as shown in FIG. 6(*e*)). In this case, dry etching is preferable as the etching. For example, reactive ion etching may be performed as the dry etching. When the silicon substrate 20 has a thickness of several ten μm or more, deep reactive ion etching may be performed. It should be noted that the restricting portion 34 extending through the silicon substrate 20 in the direction of the thickness of the silicon substrate 20 is formed between the joint portion 30 and the emulsion formation flow path 23 during the process for forming the first fluid flow path 21, the second fluid flow path 22 and the emulsion formation flow path 23.

Then, the second glass substrate 12 is prepared. The second glass substrate 12 has a thickness of 300 μm to 800 μm and a plate shape and is flat, in the same manner as the first glass substrate 11. In the case where the second glass substrate 12 is bonded with the silicon substrate 20 by anodic bonding, the second glass substrate 12 is composed of glass containing a mobile ion such as a sodium (Na) ion. The glass containing a mobile ion may be Pyrex (registered trademark of Corning Incorporated) glass.

Next, the holes 14, 15, and 16 are formed in the second glass substrate 12 by sandblasting, a carbon dioxide gas laser, a drill or the like. Specifically, the first fluid inflow hole 14 (communicating with the first fluid flow path 21 formed in the silicon substrate 20), the second fluid inflow hole 15 and the emulsion outflow hole 16 are formed in the second glass substrate 12.

After that, the second glass substrate 12 is bonded with the silicon substrate 20 by anodic bonding (as shown in FIG. 6(*f*)). For example, a voltage of approximately 300 V to 500 V is applied between the silicon substrate 20 and the second glass substrate 12 to bond the silicon substrate 20 with the second glass substrate 12 under the condition that the second glass substrate 12 and the silicon substrate 20 are heated at a temperature of 300° C. to 500° C. In this case, the surface of the second glass substrate 12, which is to be in contact with the silicon substrate 20, may be hydrophilically or hydrophobically treated by being subjected to a plasma treatment. The second glass substrate 12 and the silicon substrate 20 may be bonded with each other by using adhesive resin or by eutectic bonding. The adhesive resin may be benzocyclobutene resin.

In this way, the microchip 10 (as shown in FIG. 1) for forming an emulsion is formed.

According to the present embodiment, the emulsion formation flow path 23 is formed in the silicon substrate 20 and faces the edge portion 32 of the second fluid flow path 22; and each of the emulsions E is composed of the first fluid $F_1$ (that flows from the first fluid flow path 21) and the second fluid $F_2$ (that flows from the second fluid flow path 22) that is surrounded by the first fluid $F_1$. This configuration allows the emulsions E of approximately 1 μm or less to be uniformly sized (particle sized) and stably formed.

According to the present embodiment, each of the flow paths is formed in the silicon substrate 20 made of an inorganic material. Thus, the silicon substrate 20 is not swollen or corroded by an organic solvent, and the shapes of the flow paths are not changed due to the organic solvent. In addition, the shapes of the flow paths are not changed due to pressure of the first fluid $F_1$ and pressure of the second fluid $F_2$.

According to the present embodiment, the restricting portion 34 is provided between the joint portion 30 and the emulsion formation flow path 23. The flow of the first fluid $F_1$ flowing from the first fluid flow path 21 and the flow of the second fluid $F_2$ flowing from the second fluid flow path 22 can be concentrated on the restricting portion 34. Thus, fine emulsions of 1 μm or less can be efficiently, easily formed in a stable manner.

According to the present embodiment, the silicon substrate 20 is sandwiched by the transparent first glass substrate 11 and the transparent second glass substrate 12. This, behaviors of the emulsions in the silicon substrate 20 can be confirmed by transparent observation.

According to the present embodiment, since each of the flow paths are provided in the silicon substrate 20, the flow paths can be easily processed. For example, each of the flow paths can be finely processed with a high aspect ratio and at a submicron level.

According to the present embodiment, after the silicon substrate 20 provided on the first glass substrate 11 is polished to have the predetermined thickness, the first fluid flow path 21, the second fluid flow path 22 and the emulsion formation flow path 23 are formed in the silicon substrate 20 by etching. Since the silicon substrate 20 is polished before the formation of each of the flow paths, the flow paths are not polished. Therefore, any burr and crack are not generated at peripheries of opening portions of the flow paths. This can reduce the likelihood of a failure in processed portions of the flow paths during the manufacturing of the microchip 10 for forming an emulsion.

Second Embodiment

Figure 7:
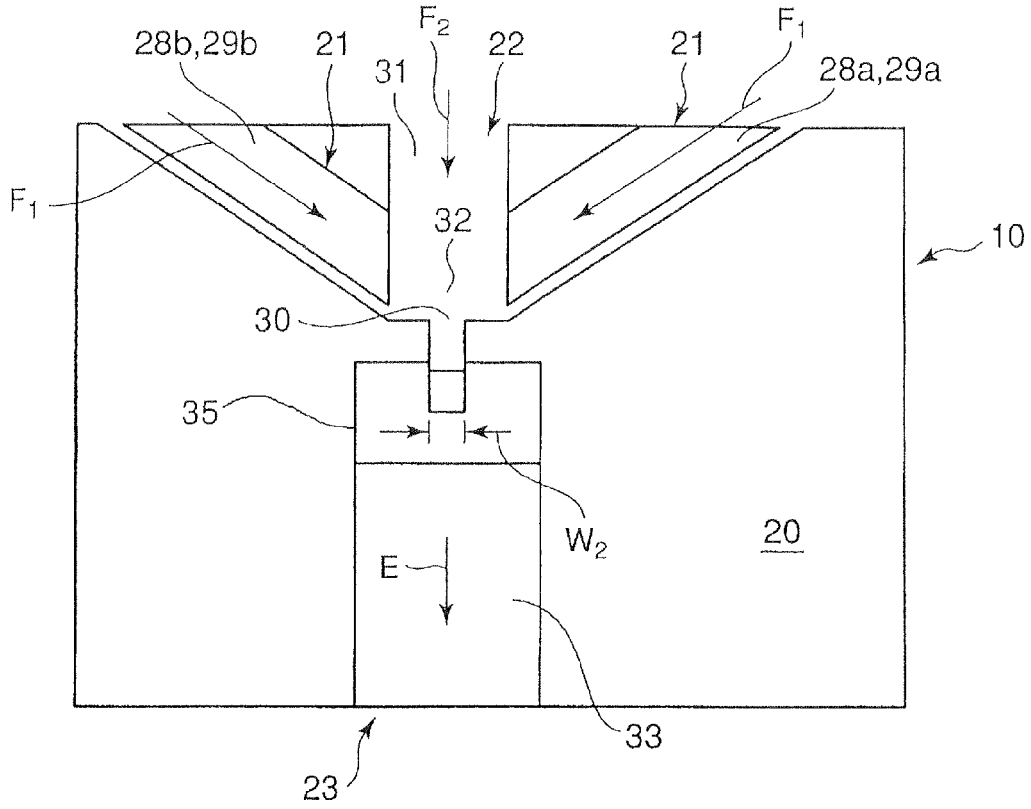
FIG. 7 is a perspective view of the periphery of a restricting portion of a silicon substrate included in a microchip for forming an emulsion according to a second embodiment of the present invention when viewed from an emulsion formation flow path.
Figure 8:
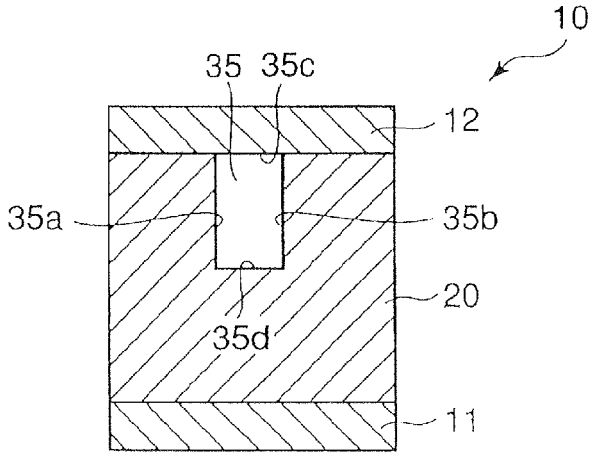
FIG. 8 is a vertical cross-sectional view of the restricting portion of the silicon substrate included in the microchip for forming an emulsion according to the second embodiment.
Figure 9:
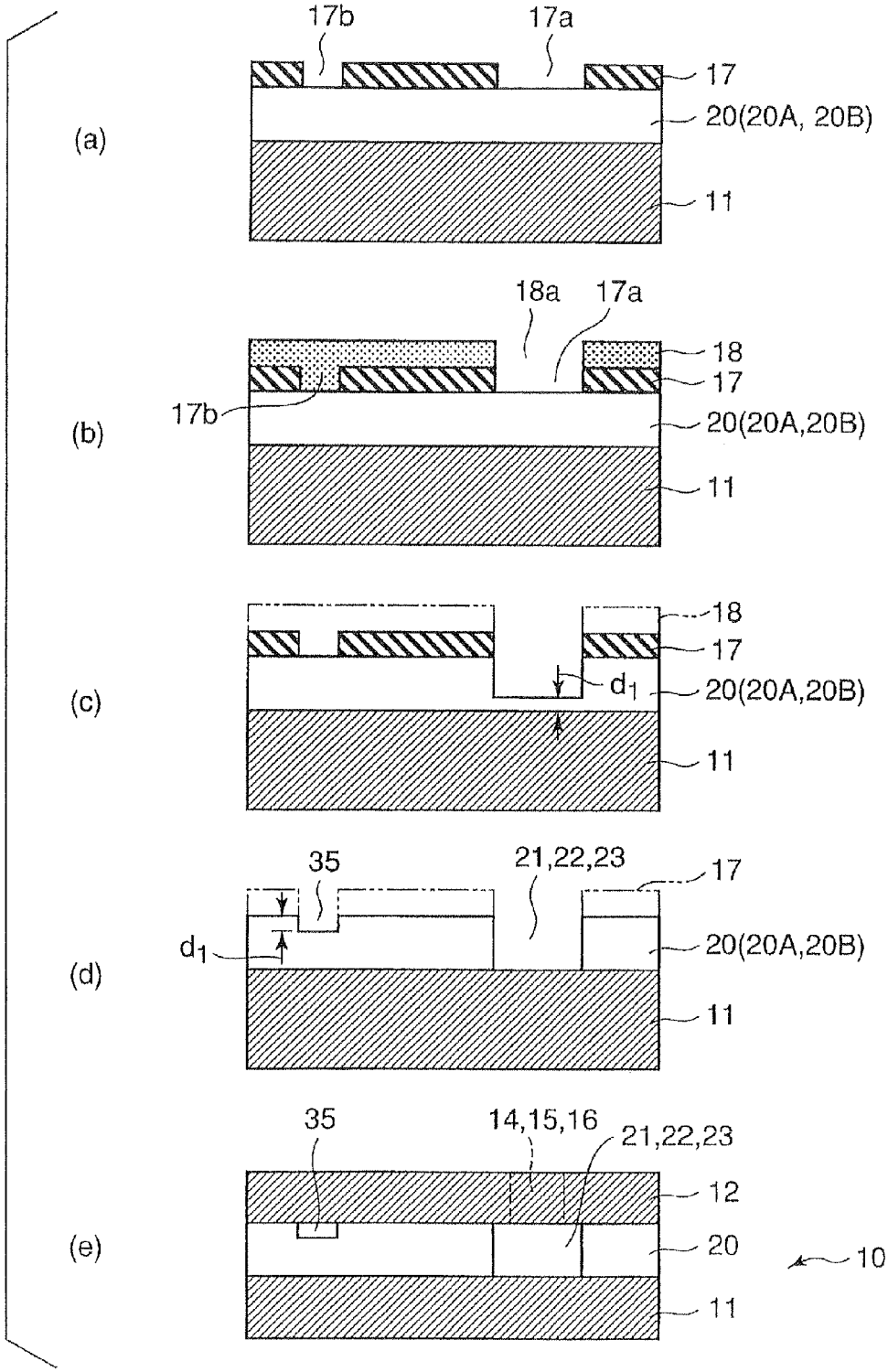
FIGS. 9(*a*) to 9(*e*) are diagrams showing a method for manufacturing the microchip for forming an emulsion according to the second embodiment.
Figure 13:
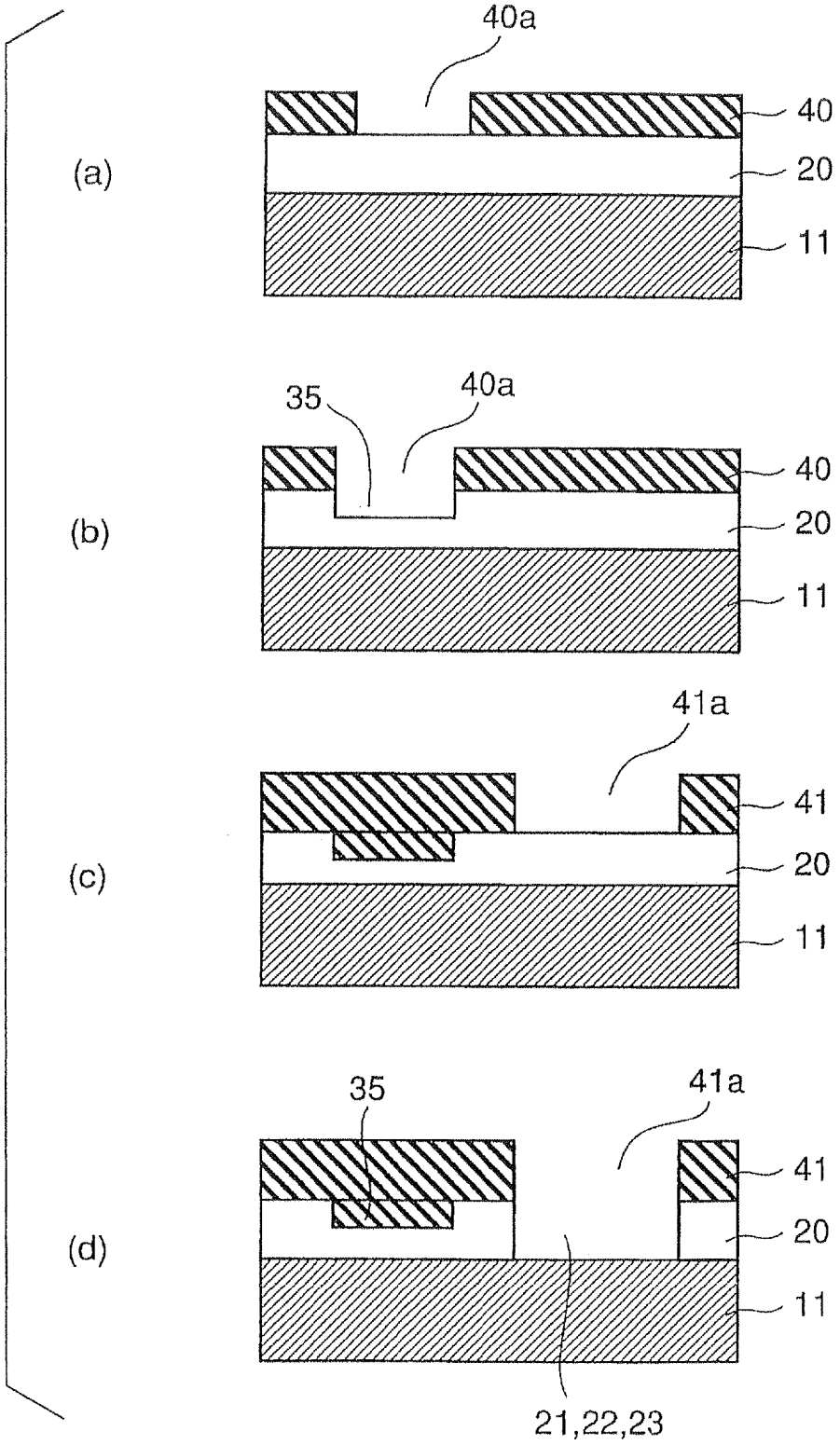
FIGS. 13(*a*) to 13(*d*) are diagrams showing a modification of a process for forming flow paths by etching in the method for manufacturing the microchip forming an emulsion according to each of the second and third embodiments.
Figure 14:
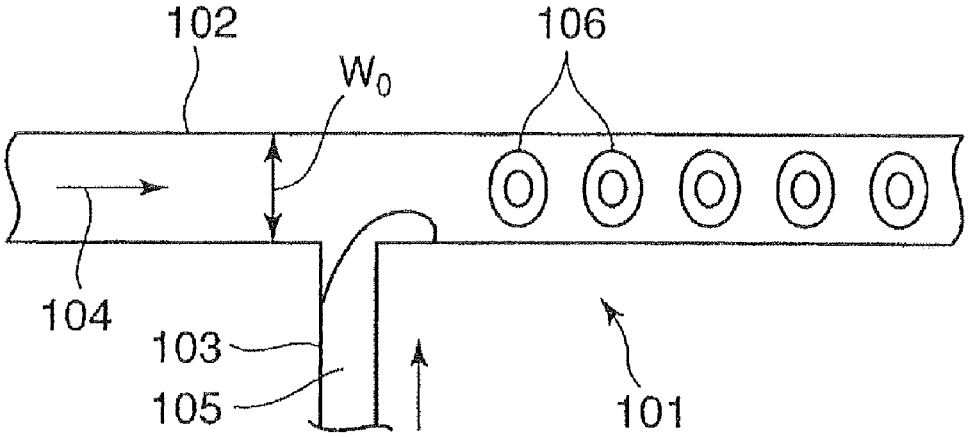
FIG. 14 is an outline diagram showing a conventional T-shaped flow path.

The second embodiment of the present invention is described below with reference to FIGS. 6(*a*) to 6(*c*), 7, 8, 9(*a*) to 9(*e*), and 13(*a*) to 13(*d*). FIG. 7 is a perspective view of the periphery of a restricting portion of a silicon substrate included in a microchip for forming an emulsion according to the second embodiment of the present invention when viewed from an emulsion formation flow path. FIG. 8 is a vertical cross-sectional view of the restricting portion of the silicon substrate included in the microchip for forming an emulsion according to the second embodiment. FIGS. 9(*a*) to 9(*e*) are diagrams showing a method for manufacturing the microchip for forming an emulsion according to the second embodiment. FIGS. 13(*a*) to 13(*d*) are diagrams showing a modification of a process for forming flow paths by etching in the method for manufacturing the microchip forming an emulsion according to the present embodiment. The restricting portion according to the second embodiment shown in FIGS. 6(*a*) to 6(*c*), 7, 8, 9(*a*) to 9(*e*), and 13(*a*) to 13(*d*) is different from the restricting portion according to the first embodiment. Other configurations according to the second embodiment are the same as those according to the first embodiment. In the second embodiment, the same elements as those in the first embodiment are denoted by the same reference numerals, and detail description thereof is omitted.

Configuration of Microchip for Forming Emulsion

In FIG. 7, reference numeral 35 denotes the restricting portion. The restricting portion 35 is provided between the joint portion 30 and the emulsion formation flow path body 33 of the emulsion formation flow path 23 in the microchip 10 for forming an emulsion according to the present embodiment. The restricting portion 35 has a width $w_2$ smaller than the width of the emulsion formation flow path body 33. The width $w_2$ of the restricting portion 35 is in a range of 1 μm to 30 μm, for example.

As shown in FIG. 8, the restricting portion 35 has a height smaller than the thickness of the silicon substrate 20, and has an opening facing toward the second glass substrate 12. The restricting portion 35 has a pair of side surfaces 35*a* and 35*b* and a bottom surface 35*d*. A top part 35*c* of the restricting portion 35 is open toward the second glass substrate 12.

The configuration of the microchip 10 for forming an emulsion according to the second embodiment is substantially the same as that of the microchip 10 for forming an emulsion according to the first embodiment except for the configuration of the restricting portion 35, and detail description thereof is omitted.

Method for Manufacturing Microchip

The method for manufacturing the microchip according to the present embodiment is described below with reference to FIGS. 6(*a*) to 6(*c*) and 9(*a*) to 9(*e*).

First, the first glass substrate 11 and the silicon substrate 20 are prepared (as shown in FIG. 6(*a*)); the silicon substrate 20 is then bonded with the first glass substrate 11 (as shown in FIG. 6(*b*)); and the silicon substrate 20 provided on the first glass substrate 11 is polished to have a predetermined thickness (as shown in FIG. 6(*c*)), in the same manner as the process shown in FIGS. 6(*a*) to 6(*c*) in the first embodiment.

Next, a first etching mask 17 having openings 17*a* and 17*b* is formed on the silicon substrate 20 (as shown in FIG. 9(*a*)). The opening 17*a* is provided at a location corresponding to the first fluid flow path 21, the second fluid flow path 22 and the emulsion formation flow path 23. The opening 17*b* is provided at a location corresponding to the restricting portion 35. The first etching mask 17 may be made of a metal material such as a silicon dioxide film.

Then, a second etching mask 18 is formed on the first etching mask 17 (as shown in FIG. 9(*b*)). The second etching mask 18 has an opening 18*a*. The opening 18*a* is provided at a location corresponding to the first fluid flow path 21, the second fluid flow path 22 and the emulsion formation flow path 23 (i.e., the opening 18*a* is provided at a location corresponding to the opening 17*a* of the first etching mask 17). The second etching mask 18 does not have an opening provided at a location corresponding to the restricting portion 35 (i.e., the second etching mask 18 does not have an opening provided at a location corresponding to the opening 17*b* of the first etching mask 17). As a result, the second etching mask 18 covers the opening 17*b* of the first etching mask 17. The second etching mask 18 may be a resist.

Then, a portion of the silicon substrate 20 is etched in the direction of the thickness of the silicon substrate 20 by using the second etching mask 18 (first etching: FIG. 9(*c*)). In this case, the first etching is performed to ensure that a remaining portion of the silicon substrate 20 has a height $d_1$ equal to the depth of the restricting portion 35 to be formed. After that, the second etching mask 18 is removed by oxygen ashing or dissolved by a solvent so that it may be removed.

Then, a portion of the silicon substrate 20 is etched in the direction of the thickness of the silicon substrate 20 by using the first etching mask 17 (second etching: FIG. 9(*d*)). This allows the first fluid flow path 21, the second fluid flow path 22 and the emulsion formation flow path 23 to be formed at locations corresponding to the opening 17*a*. In addition, the restricting portion 35 is formed at a location corresponding to the opening 17*b*. The height $d_1$ of the restricting portion 35 is smaller than the thickness of the silicon substrate 20. After that, the first etching mask 17 is removed by dry etching or the like.

Then, the second glass substrate 12 is prepared. The second glass substrate 12 has a thickness of 300 μm to 800 μm and a plate shape and is flat, as described in the process shown in FIG. 6(*f*). The second glass substrate 12 is composed of glass containing a mobile ion such as a sodium (Na) ion. After that, the first fluid inflow hole 14 (communicating with the first fluid flow path 21 formed in the silicon substrate 20), the second fluid inflow hole 15 and the emulsion outflow hole 16 are formed in the second glass substrate 12 by sandblasting, a carbon dioxide gas laser, a drill or the like. The first fluid inflow hole 14, the second fluid inflow hole 15 and the emulsion outflow hole 16 extend through the second glass substrate 12.

After that, the silicon substrate 20 and the second glass substrate 12 are bonded with each other by anodic bonding (as shown in FIG. 9(*e*)). In this case, a voltage of 300 V to 500 V is applied between the second glass substrate 12 and the silicon substrate 20 to bond the second glass substrate 12 with the silicon substrate 20 by anodic bonding under the condition that the second glass substrate 12 and the silicon substrate 20 are heated at a temperature of 300° C. to 500° C. The second glass substrate 12 and the silicon substrate 20 may be bonded with each other by means of adhesive resin or by eutectic bonding. In this way, the microchip 10 for forming an emulsion is formed (as shown in FIG. 9(*e*)).

Modification of Process for Forming Flow Paths by Etching

Next, a description is made of a modification of the process (shown in FIGS. 9(*a*) to 9(*d*)) for forming the flow paths in the silicon substrate 20 by etching in the method for manufacturing the microchip for forming an emulsion according to the present embodiment, with reference to FIGS. 13(*a*) to 13(*d*).

First, a first etching mask 40 is formed in the silicon substrate 20 (as shown in FIG. 13(*a*)). The first etching mask 40 has an opening 40*a* provided at a location corresponding to the restricting portion 35.

Next, a portion of the silicon substrate 20 is etched in the direction of the thickness of the silicon substrate 20 by using the first etching mask 40 (first etching: FIG. 13(*b*)) to form the restricting portion 35 having a predetermined depth in the silicon substrate 20. After that, the first etching mask 40 is removed.

Then, a second etching mask 41 is formed on the silicon substrate 20 (as shown in FIG. 13(*c*)). The second etching mask 41 has an opening 41*a* provided at a location corresponding to the first fluid flow path 21, the second fluid flow path 22 and the emulsion formation flow path 23. The second etching mask 41 covers the restricting portion 35. It is preferable that the second etching mask 41 be formed by spin coating or spray coating.

Then, portions of the silicon substrate 20 are etched in the direction of the thickness of the silicon substrate 20 by using the second etching mask 41 (second etching: FIG. 13(*d*)) to form the first fluid flow path 21, the second fluid flow path 22 and the emulsion formation flow path 23 at locations corresponding to the opening 41*a*. After that, the second etching mask 41 is removed. In this way, the silicon substrate 20 having the first fluid flow path 21, the second fluid flow path 22 and the emulsion formation flow path 23 is formed, similarly to the silicon substrate 20 formed in the process shown in FIG. 9(*d*).

According to the present embodiment, the silicon substrate 20 has the restricting portion 35 formed therein. The restricting portion 35 has the height smaller than the thickness of the silicon substrate 20 and is open toward the second glass substrate 12. The flow of the first fluid $F_1$ flowing from the first fluid flow path 21 and the flow of the second fluid $F_2$ flowing from the second fluid flow path 22 can be concentrated on the restricting portion 35. Thus, fine emulsions of 1 μm or less can be efficiently, easily formed in a stable manner.

Third Embodiment

Figure 10:
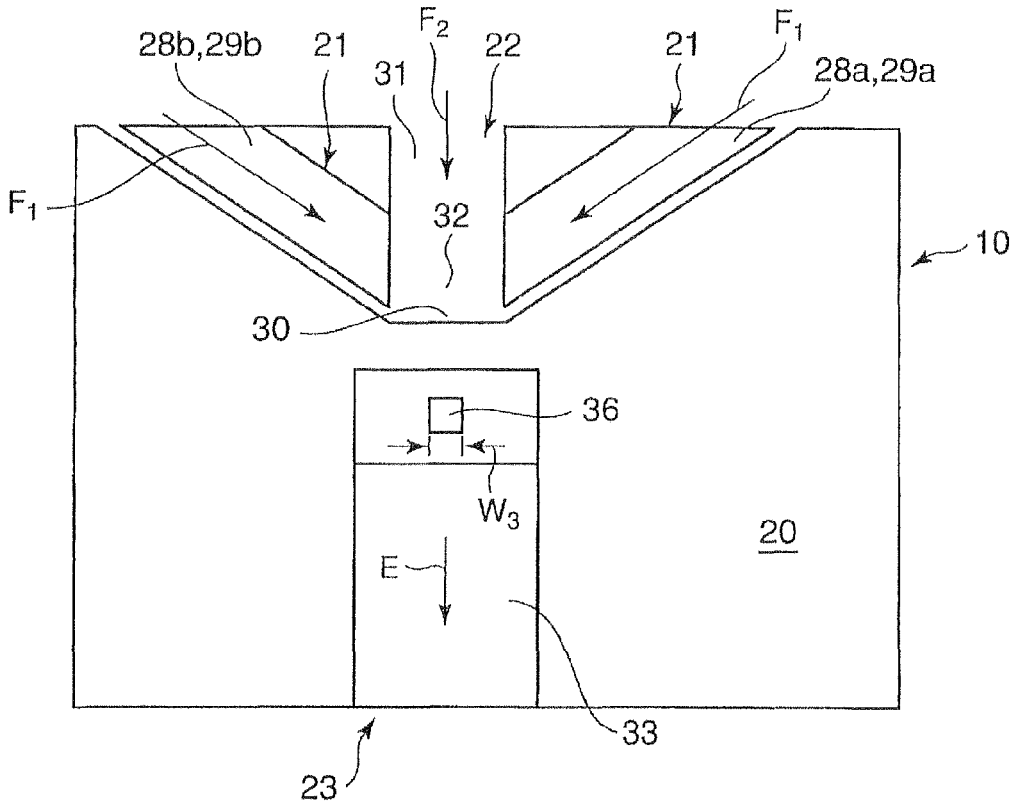
FIG. 10 is a perspective view of the periphery of a restricting portion of a silicon substrate included in a microchip for forming an emulsion according to a third embodiment of the present invention when viewed from an emulsion formation flow path.
Figure 11:
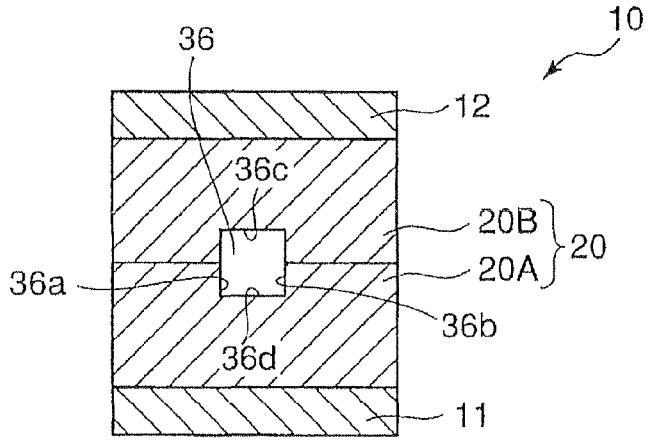
FIG. 11 is a vertical cross-sectional view of the restricting portion of the silicon substrate included in the microchip for forming an emulsion according to the third embodiment.

A method for manufacturing a microchip according to the third embodiment of the present invention is described below with reference to FIGS. 6(*a*) to 6(*c*), 9(*a*) to 9(*d*), 10, 11, 12(*a*), 12(*b*), and 13(*a*) to 13(*d*). FIG. 10 is a perspective view of the periphery of a restricting portion of a silicon substrate included in the microchip for forming an emulsion according to the present embodiment when viewed from an emulsion formation flow path. FIG. 11 is a vertical cross-sectional view of the restricting portion of the silicon substrate included in the microchip for forming an emulsion according to the present embodiment. FIGS. 6(*a*) to 6(*c*), 9(*a*) to 9(*d*), 12(*a*) and 12(*b*) are diagrams showing the method for manufacturing the microchip for forming an emulsion according to the present embodiment. The restricting portion according to the third embodiment shown in FIGS. 6(*a*) to 6(*c*), 9(*a*) to 9(*d*), 10, 11, 12(*a*), 12(*b*), 13(*a*) to 13(*d*) is different from the restricting portion according to each of the first and second embodiments. Other configurations according to the third embodiment are the same as those according to the first and second embodiments. In the third embodiment, the same elements as those in the first and second embodiments are denoted by the same reference numerals, and detail description thereof is omitted.

Configuration of Microchip for Forming Emulsion

In FIG. 10, reference numeral 36 denotes the restricting portion. The restricting portion 36 is provided between the joint portion 30 and the emulsion formation flow path body 33 of the emulsion formation flow path 23 in the microchip 10 for forming an emulsion according to the present embodiment. The restricting portion 36 has a width $w_3$ smaller than the width of the emulsion formation flow path body 33. The width $w_3$ of the restricting portion 36 is in a range of 1 μm to 30 μm, for example.

As shown in FIG. 11, the silicon substrate 20 is formed by bonding a silicon substrate portion 20A with a silicon substrate portion 20B. The restricting portion 36 is provided at a location at which the silicon substrate portion 20A is bonded with the silicon substrate portion 20B. The restricting portion 36 has a pair of side surfaces 36*a* and 36*b*, a top surface 36*c* and a bottom surface 36*d*. That is, entire surface of the restricting portion 36 are surrounded by the silicon substrate 20.

The configuration of the microchip 10 for forming an emulsion according to the third embodiment is substantially the same as that of the microchips 10 for forming an emulsion according to the first and second embodiments except for the configuration of the restricting portion 36, and detail description thereof is omitted.

Method for Manufacturing Microchip

The method for manufacturing the microchip according to the present embodiment is described below with reference to FIGS. 6(*a*) to 6(*c*), 9(*a*) to 9(*d*), 12(*a*) and 12(*b*).

First, in the same manner as the process shown in FIGS. 6(*a*) to 6(*c*) in the first and second embodiments, the first glass substrate 11 and the silicon substrate portion 20A are prepared (as shown in FIG. 6(*a*)). The first glass substrate 11 is bonded with the silicon substrate portion 20A (as shown in FIG. 6(*b*)). After that, the silicon substrate portion 20A provided on the first glass substrate 11 is polished to have a predetermined thickness (as shown in FIG. 6(*c*)).

Next, in the same manner as the process shown in FIGS. 9(*a*) to 9(*d*) in the first and second embodiments, the first etching mask 17 having the opening 17*a* and the opening 17*b* is formed on the silicon substrate portion 20A (as shown in FIG. 9(*a*)). The opening 17*a* is provided at a location corresponding to the first fluid flow path 21, the second fluid flow path 22 and the emulsion formation flow path 23, while the opening 17*b* is provided at a location corresponding to the restricting portion 36. Then, the second etching mask 18 having the opening 18*a* is formed on the first etching mask 17 (as shown in FIG. 9(*b*)). The opening 18*a* is provided at a location corresponding to the first fluid flow path 21, the second fluid flow path 22 and the emulsion formation flow path 23. The opening 17*b* of the first etching mask 17 is covered with the second etching mask 18.

Next, a portion of the silicon substrate portion 20A is etched in the direction of the thickness of the silicon substrate portion 20A by using the second etching mask 18 (first etching: FIG. 9(*c*)). In this case, the first etching is performed to ensure that a remaining portion of the silicon substrate 20 has a height $d_1$ equal to the depth of the restricting portion 36. Then, another portion of the silicon substrate portion 20A is etched in the direction of the thickness of the silicon substrate portion 20A by using the first etching mask 17 (second etching: FIG. 9(*d*)).

Figure 12:
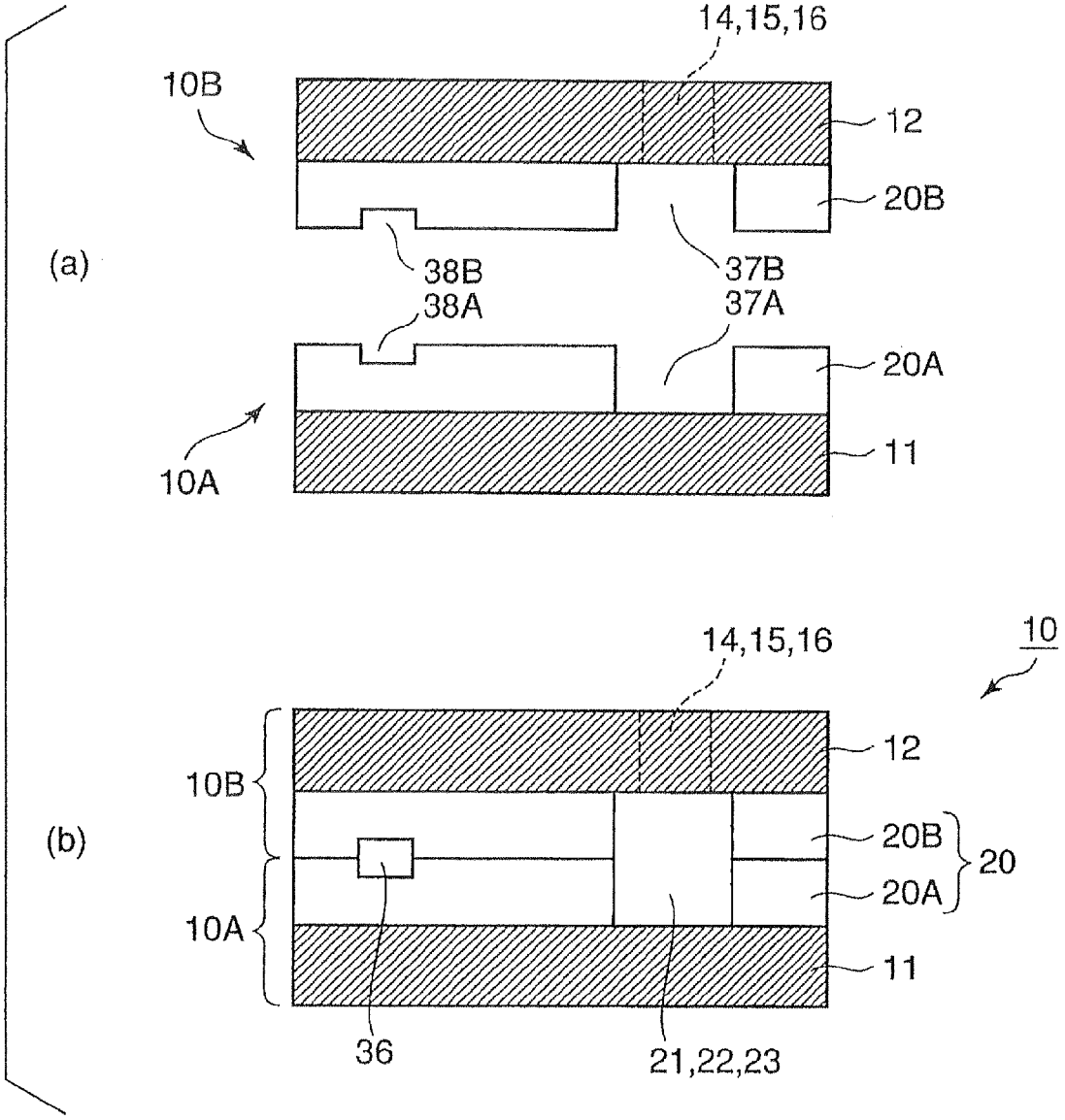
FIGS. 12(*a*) and 12(*b*) are diagrams showing a method for manufacturing the microchip for forming an emulsion according to the third embodiment.

In this way, a first microchip portion 10A composed of the first glass substrate 11 and the silicon substrate portion 20A is formed (as shown in FIG. 12(*a*)). The silicon substrate portion 20A has a through-hole 37A and a recessed portion 38A. The through-hole 37A of the silicon substrate portion 20A has a flat shape corresponding to the first fluid flow path 21, the second fluid flow path 22 and the emulsion formation flow path 23. The recessed portion 38A of the silicon substrate portion 20A has a flat shape corresponding to the restricting portion 36.

Similarly to the first microchip portion 10A, a second microchip portion 10B is formed (as shown in FIG. 12(*a*)) in accordance with the process shown in FIGS. 6(*a*) to 6(*c*) and 9(*a*) to 9(*d*). The second microchip portion 10B is composed of the second glass substrate 12 and the silicon substrate portion 20B. The silicon substrate portion 20B has a through-hole 37B and a recessed portion 38B. The through-hole 37B of the silicon substrate portion 20B has a flat shape corresponding to the first fluid flow path 21, the second fluid flow path 22 and the emulsion formation flow path 23. The recessed portion 38B of the silicon substrate portion 20B has a flat shape corresponding to the restricting portion 36.

Next, the first microchip portion 10A and the second microchip portion 10B are bonded with each other (as shown in FIG. 12(*a*)). In this case, the silicon substrate portion 20A and the silicon substrate portion 20B are provided so as to face each other and bonded with each other. This bonding method can be selected from direct bonding (plasma bonding), eutectic bonding, bonding using adhesive resin, and the like.

In this way, the microchip 10 for forming an emulsion is formed (as shown in FIG. 12(*b*)). The silicon substrate 20 is formed by bonding the silicon substrate portion 20A with the silicon substrate portion 20B. The first fluid flow path 21, the second fluid flow path 22 and the emulsion formation flow path 23 are formed by the through-hole 37A of the silicon substrate portion 20A and the through-hole 37B of the silicon substrate portion 20B. The restricting portion 36 entirely surrounded by the silicon substrate 20 is formed by the recessed portion 38A of the silicon substrate portion 20A and the recessed portion 38B of the silicon substrate portion 20B.

In the present embodiment, the process shown in FIGS. 13(*a*) to 13(*d*) may be performed to etch the silicon substrate portion 20A and the silicon substrate portion 20B instead of the process shown in FIGS. 9(*a*) to 9(*d*).

According to the present embodiment, the surfaces (which are the side surfaces 36*a* and 36*b*, the top surface 36*c* and the bottom surface 36*d*) of the restricting portion 36 are surrounded by the silicon substrate 20. Thus, emulsions E can be formed in a stable manner even when the first fluid $F_1$ is composed of water and the second fluid $F_2$ is composed of oil (oil-in-water type) and even when the first fluid $F_1$ is composed of oil and the second fluid $F_2$ is composed of water (water-in-oil type). That is, when water and oil that will flow in the flow paths (first and second fluid flow paths 21, 22) are switched to each other, the type (oil-in-water type or water-in-oil type) of emulsions to be formed can be switched to the other type (water-in-oil type or oil-in-water type).

In the present embodiment, a third fluid flow path may be provided between the first fluid flow path 21 and the emulsion formation flow path 23 to form a water-oil-water double emulsion and an oil-water-oil double emulsion.

Modification

The first fluid $F_1$ introduced from the first fluid inflow hole 14 is divided at the branch portion 27 of the first fluid flow path 21, and the divided first fluids $F_1$ flow in the branched flow paths 28*a* and 28*b* and join at the joint portion 30, in each of the first to third embodiments. The configuration of the microchip, however, is not limited to this. An inflow hole through which the fluid that will flow in the branched flow path 28*a* is introduced, and an inflow path through which the fluid that will flow in the branched flow path 28*b* is introduced, may be separately provided. In this case, the types, components, pressure levels and the like of the fluids flowing in the branched flow paths 28*a* and 28*b* may be different from each other.

The first fluid flow path 21 has the pair of branched flow paths 28*a* and 28*b* in each of the first to third embodiments. The first fluid flow path 21 may have three or more of branched flow paths.

The first fluid inflow hole 14, the second fluid inflow hole 15 and the emulsion outflow hole 16 are provided in the second glass substrate 12 in each of the first to third embodiments. The configuration of the microchip, however, is not limited to this. A part or all of the first fluid inflow hole 14, the second fluid inflow hole 15 and the emulsion outflow hole 16 may be provided in the first glass substrate 11.

What is claimed is:

1. A method for manufacturing a microchip adapted to form an emulsion and having a first glass substrate, a second glass substrate and a silicon substrate provided between the first and second glass substrates, comprising:

preparing the first glass substrate and the silicon substrate;

bonding the first glass substrate with the silicon substrate;

polishing the silicon substrate provided on the first glass substrate to ensure that the silicon substrate has a predetermined thickness;

forming flow paths in the silicon substrate having the predetermined thickness by etching; and bonding the second glass substrate with the silicon substrate having the flow paths formed therein, wherein in forming the flow paths in the silicon substrate, a first fluid flow path through which a first fluid flows is formed in the silicon substrate, a second fluid flow path through which a second fluid that is not mixed with the first fluid flows is formed in the silicon substrate, and an emulsion formation flow path is formed in the silicon substrate to form an emulsion composed of the first fluid and the second fluid that is surrounded by the first fluid, the first fluid flow path has a plurality of branched flow paths that join at a joint portion, and the second fluid flow path has an edge portion that communicates with the joint portion.

2. The method for manufacturing the microchip for forming an emulsion according to claim 1, wherein in forming the flow paths in the silicon substrate, a restricting portion extending through the silicon substrate in the direction of the thickness of the silicon substrate is formed between the joint portion and the emulsion formation flow path.

3. The method for manufacturing the microchip for forming an emulsion according to claim 1, wherein in forming the flow paths in the silicon substrate, a restricting portion is formed between the joint portion and the emulsion formation flow path, the restricting portion having a height smaller than the thickness of the silicon substrate and having an opening facing toward the second glass substrate.

4. The method for manufacturing the microchip for forming an emulsion according to claim 1, wherein in forming the flow paths in the silicon substrate, a restricting portion is formed between the joint portion and the emulsion formation flow path, the surfaces of the restricting portion being entirely surrounded by the silicon substrate.

* * * * *